US006398660B1

(12) United States Patent
Probst et al.

(10) Patent No.: US 6,398,660 B1
(45) Date of Patent: Jun. 4, 2002

(54) BILLIARD CUE HAVING A VIBRATION DAMPING AXIAL ALIGNING SHAFT-HANDLE CONNECTOR

(75) Inventors: Frederick E. Probst, Santa Fe; Bernardus W. Van Nieuwenborg, Albuquerque, both of NM (US)

(73) Assignee: Santa Fe Billiard Co., Santa Fe, NM (US)

( * ) Notice: Subject to any disclaimer, the term of this patent is extended or adjusted under 35 U.S.C. 154(b) by 0 days.

(21) Appl. No.: 09/670,974

(22) Filed: Sep. 27, 2000

(51) Int. Cl.[7] ..... A63D 15/08
(52) U.S. Cl. ..... 473/44
(58) Field of Search ..... 473/44–49; 403/292, 403/297, 306, 307, 314

(56) References Cited

U.S. PATENT DOCUMENTS 3,269,730 A * 8/1966 Miller et al. ..... 29/450
3,368,271 A * 2/1968 Scheffler ..... 273/DIG. 7
4,231,574 A * 11/1980 Williams ..... 403/292
5,514,039 A * 5/1996 Gendron et al. ..... 473/44
5,643,095 A * 7/1997 Probst ..... 473/44
5,749,788 A * 5/1998 Bourque ..... 403/292
5,890,966 A * 4/1999 Costain et al. ..... 473/44
6,027,410 A * 2/2000 Costain et al. ..... 473/44
6,183,371 B1 * 2/2001 Wethered ..... 473/44

* cited by examiner

*Primary Examiner*—Mark S. Graham
(74) *Attorney, Agent, or Firm*—Daniel Robbins

(57) ABSTRACT

A male/female billiard cue connector provides multi-directional vibration damping as well as accurate alignment of the cue's handle and shaft. The strike of the cue against the cue ball causes a longitudinal shock wave to traverse the length of the cue generating strong transient forces within the cue. Due to the rigidity of the cue, this longitudinal wave also excites lateral vibrations in the structure which cause the cue to bend and flex, and the resultant forces wear and abrade the connector elements. The connector provides protection against these forces, as well as assuring true axial alignment of the cue. The male section of the connector, fitting into a cavity in the female section, has two circumferential rubber "O" rings that are in contact with the walls of the female connector when the male and female sections are joined. These "O" rings absorb and dissipate the energy of the lateral vibrations induced in the cue. Additionally, the male section screws onto the threaded end of a spring loaded axially "floating" plug in the female cavity, to provide accurate axial alignment of the connector parts, while allowing a slight axial movement between them. Sandwiched between the male and female sections is a resilient mechanically dissipative disk that cushions the relative axial movement of the connector parts during the strike impulse, and absorbs the longitudinal shock wave.

22 Claims, 2 Drawing Sheets

BILLIARD CUE HAVING A VIBRATION DAMPING AXIAL ALIGNING SHAFT-HANDLE CONNECTOR

BACKGROUND OF THE INVENTION

1. Field of the Invention

This invention relates to a billiard cue, and in particular to a two piece billiard cue having a connector for joining the handle to the shaft.

2. Description Relative to the Prior Art

As the typical billiard cue has a length of about 60 inches, it is convenient to separate the handle from the shaft to provide ease of handling during transportation. The prior art teaches connectors for joining the handle to the shaft of the cue, and in particular U.S. Pat. No. 5,643,095 issued in the name of Probst discloses one embodiment of a quick acting connector, and a second embodiment disclosing the quick acting connector with a resilient member between the shaft and handle that cushions the longitudinal shock transmitted through the billiard cue when striking the cue ball. U.S. Pat. No. 5,643,095 in its entirety is hereby incorporated by reference. The prior art recognizes that the longitudinal component of a shock wave travelling along the cue length could be dissipated by material positioned to absorb the longitudinal wave and to stop the shock from being transmitted to the player. The present invention discloses a billiard cue connector aimed at solving a separate shock wave problem induced in the cue by the impact of the cue stick and cue ball not considered in the prior art.

SUMMARY OF THE INVENTION

The present invention relates to shock wave induced lateral vibrational modes in a billiard cue and connector. A male/female billiard cue connector provides multi-directional vibration damping as well as accurate alignment of the cue's handle and shaft. The strike of the cue against the cue ball causes a longitudinal shock wave to traverse the length of the cue generating strong transient forces within the cue. Due to the rigidity of the cue, this longitudinal wave also excites lateral vibrations in the structure which cause the cue to bend and flex, and the resultant forces wear and abrade the connector elements. The present invention provides protection against these forces, as well as assuring true axial alignment of the cue during assembly and play. The male section of the connector, fitting into a cavity in the female section, has two circumferential rubber "O" rings that are in contact with the walls of the female connector when the male and female sections are joined. These "O" rings absorb and dissipate the energy of the lateral vibrations induced in the cue. Additionally, the male section screws onto the threaded end of a spring loaded axially "floating" plug in the female cavity, to provide accurate axial alignment of the connector parts, while allowing a slight axial movement between them. Sandwiched between the male and female sections is a resilient mechanically dissipative disk that cushions the relative axial movement of the connector parts during the strike impulse, and that absorbs the longitudinal shock wave traversing the cue.

BRIEF DESCRIPTION OF THE DRAWINGS

The invention will be described with respect to the drawings of which.

DESCRIPTION OF THE PREFERRED EMBODIMENT

Figure 2:
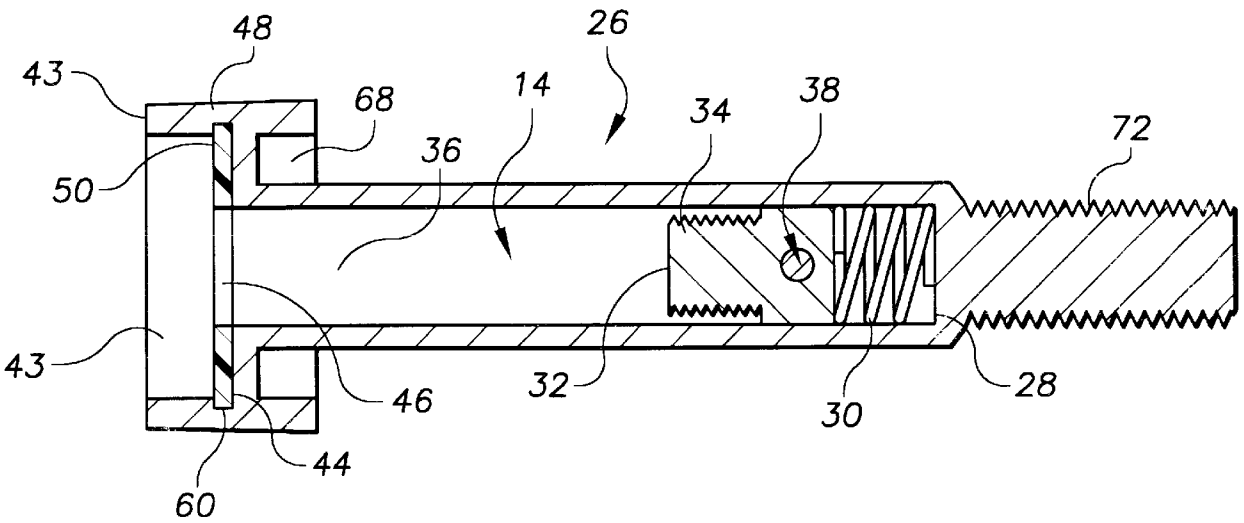
FIG. 2 is a sectional drawing of the female section of the connector of the invention.
Figure 3:
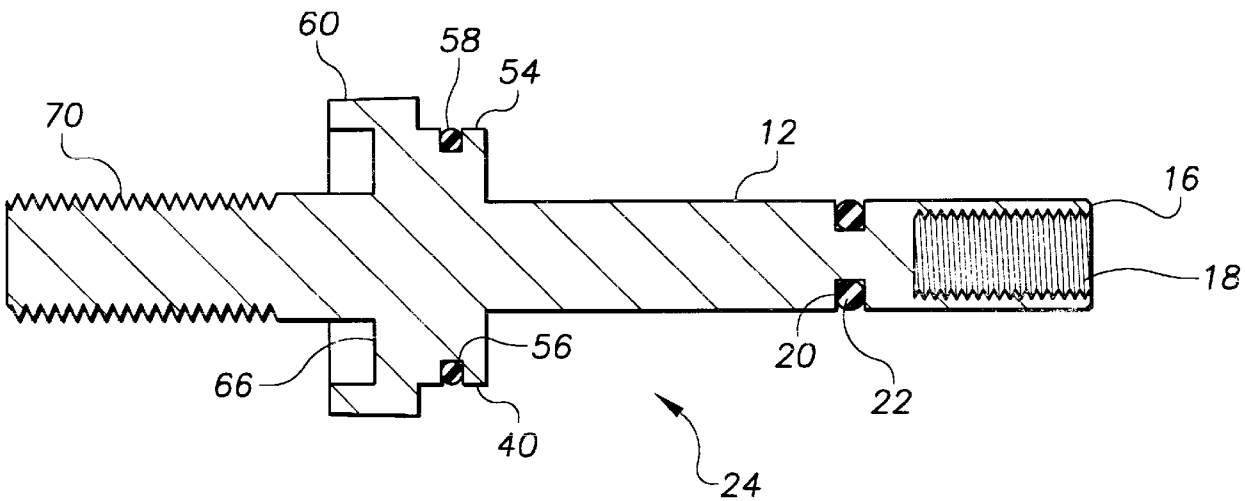
FIG. 3 is a sectional drawing of the male section of the connector of the invention.

The connector of the invention 10 has a cylindrical male insertable shaft 12 that slides into and which snugly fits into a female mating cavity 14 . The insertion end 16 of the male shaft 12 is a cylindrical section having an internally tapped tubular part 18 axially aligned along the shaft 12, and located at the distal end of the shaft 12. Just behind the tapped tubular part 18, the male shaft 12 has a groove 20, and an "O" ring 22 is circumferentially mounted in the groove 20. This "O" ring 22 both aligns the male 24 and female 26 sections of the connector 10 and provides damping of the transverse vibrations induced in the billiard cue by the shock wave travelling the length of the cue. The distal end 28 of the female cavity 14, (that is, the end away from the entrance for the male shaft), contains a spring 30 attached to a plug 34 with which the tubular part 18 at the end of the male shaft 12 makes contact. Attached to the end of the plug 34, and directed into the cavity 14 towards the proximate end 36 of the cavity 14, is an axially oriented post 32. This post 32 is threaded to mate with the tapped tubular hole 18 of the male shaft 12. To prevent the angular movement of the plug during the threading process, a pin 38, perpendicular to the cavity's longitudinal direction, passes through the plug 34 and rides in a longitudinal slot of the wall of the female cavity 14. (This slot is not seen in the sectional view of FIG. 2). Thus, the plug 34 can move axially in the body of the female cavity 14, but is restrained from rotation by the pin 38 captive in the cavity's 14 wall slot. In joining the male 24 and female 26 sections, the male shaft 12 is slidingly inserted into the female cavity 14 and the male 24 section is rotated screwing the threaded post 32 into the internally tapped tubular hole 18 . The threaded end of the post 32 does not bottom in the tapped tubular hole 18; a two step plug 40 portion of the male 24 and a cupped end 42 portion of the female 26 come into face to face abutment stopping further advance of the male 24 into the female 26 section, as will be explained below.

The cupped end 42 of the female section 26 is a larger diameter cylindrical shape whose base 44 contains a central hole 46 coaxial with, and having the same diameter as the female cavity 14. Mounted in face to face contact with the base 44 of the cupped end 42 is a mechanically dissipative disk 48 with a clearance hole through which the male shaft 12 insert end 16 enters the female cavity 14. Backing up the dissipative disk 48 is a thin plastic shim 50, such as teflon or delrin, having the same diameter as the disk 48 and also having a central coaxial hole. The inner cylindrical surface of the cupped end 42 is grooved 52 at its base 44, to hold the slightly larger diameters disk 48 and shim 50 captive.

The proximate end of the male shaft 12, which is away from its tapped tubular hole 18 end, terminates in the two step cylindrical plug 40 coaxial with the male shaft 12. The first step 54 of the plug 40, adjacent to the male shaft portion 12, has a diameter that provides a slip fit with the cupped end 42 of the female 26 when the male shaft 12 is inserted into the female cavity 14. The cylindrical surface of the first step 54 has a circumferential groove 56 in which is also mounted an "O" ring 58. This "O" ring 58, like the "O" ring 22 around the male shaft 12, as described above, also attenuate and dampens transverse vibrations induced by the stroke of the cue against the cue ball, as well as insuring the alignment of the connector 10 sections during mating of the connector 10. The "O" rings 22 and 58, and the disk 48 may be natural or synthetic rubber, or plastic elastomers such as ethylene or polyurethane. The second step 60 of the plug 40, proximate the first step 58 has a diameter just equal to the outer diameter of the cupped end 42 terminating the female section 26.

Figure 1:
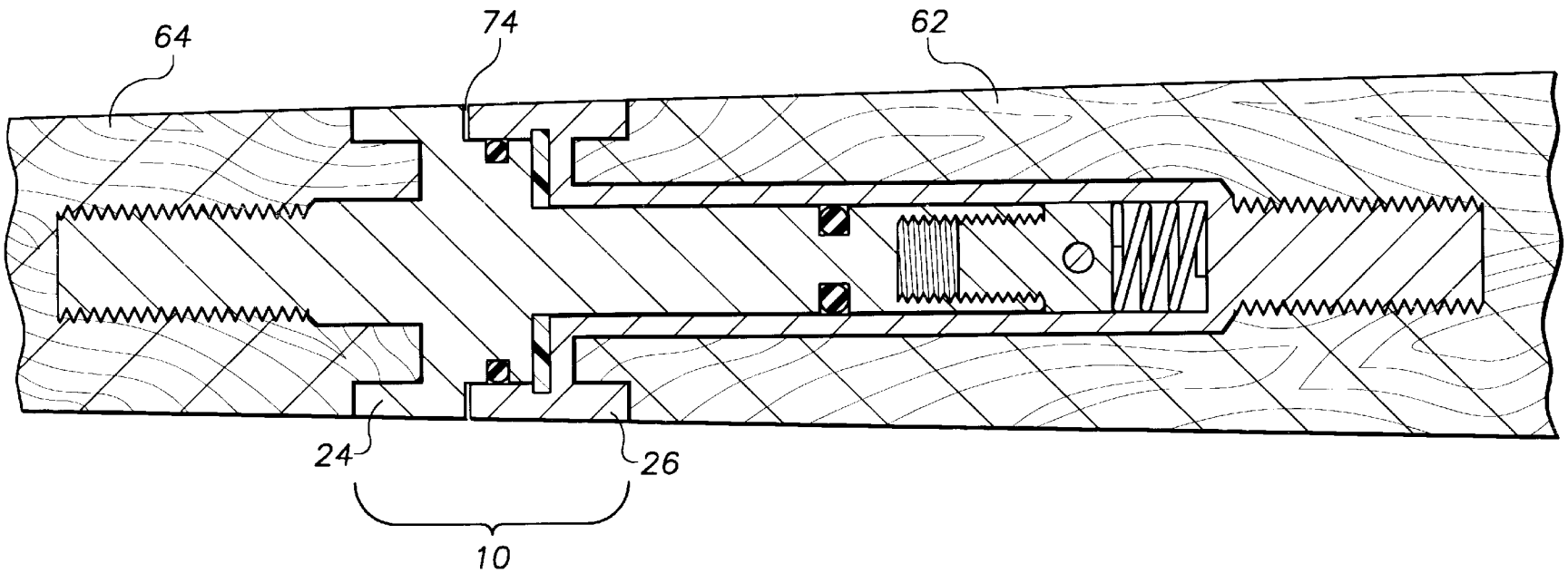
FIG. 1 is a sectional drawing through the handle and shaft segments of a billiard cue, showing the connector of the invention in place.

Referring to FIG. 1, the connector 10 is seen as mounted in the handle 64 and shaft 62 of a cue, with the male section 24 of the connector 10 mated to the female section 26. It will be noted that the handle 64 and shaft 62 are conventionally made of wood, and are tapped to receive the mounting screws 70, 72 of the connector sections 24, 26. The mating ends of the handle 64 and shaft 62 are also cut away forming cylindrical rims that fit into the receptacles 66, 68 of the male and female sections 24, 26.

As described above, the male section 24 mates with the female section 24 by the threaded post 32 being screwed into the tubular tapped hole 18; the threaded post 32 not bottoming in the tubular tapped hole 18. It is kept from bottoming by the first step of the two step plug 40 coming into face to face contact with the shim 50 at the bottom of the cupped end of the female section 26 before the threaded post 32 bottoms in the tapped tubular hole 18. The stepped plug 40 and the cupped end 42 are also dimensioned that with the stepped plug 40 in contact with the shim 50, a small gap 74 exists between the face of the second step 60 and the circular face 43 of the cupped end 42. The gap 74 allows a slight axial movement between the male section 24 and the female section 26 during the strike of the cue against the cue ball, so that the dissipative disk 48 is compressed by the shock. Also with the male section 24 and the female section 26 mated, the O ring 22 is in intimate contact with the cavity 14 wall, and the O ring 58 is similarly in intimate contact with the cylindrical wall of the cupped end 42. The dissipative disk 48 and O rings 22, 58 absorb the shock wave traversing the cue during a strike.

The O rings 22, 58 may be lubricated, preferably with a silicone, to reduce friction during assembly of the male section 24 to the female section 26, and to further act as a preservative of the O ring material.

It will be noted that the outer cylindrical surfaces of the connector 10 are slightly tapered so that when the connector 10 is assembled in a handle 62 and shaft 64, a smooth transition occurs from the handle 62 across the connector 10 to the shaft 64.

The invention has been described in detail with particular reference to preferred embodiments thereof, but it will be understood that variations and modifications can be effected within the spirit and scope of the invention.

What is claimed is:

1. A two piece billiard cue comprising:

a) a first axially symmetrical section of said cue, b) a second axially symmetrical section of said cue, c) a connector for joining said first section and said second section of said cue, the outer surfaces of said connector tapered to conform to said billiard cue taper, d) said connector further comprising an axially extending male member and an axially extending female member, e) a first end of said male member fixedly mounted in said first section of said cue, and a first end of said female member fixedly mounted in said second section of said cue, f) a second end of said male member comprising an insertable shaft, g) a second end of said female member comprising first and second coaxially oriented cavities for capturing said insertable shaft of said male member, said first cavity being a smaller diameter than said second cavity, said insertable shaft of said male member for extension through said second cavity into said first cavity, said second cavity located in said female section distal to said first end of said female member, h) said male member having first and second "O" rings circumferentially mounted thereon, said "O" rings comprising mechanically dissipative material, i) said first and said second cavities of said female member having first and second coaxial cylindrical walls, said first cylindrical wall adapted for contacting said first "O" ring, and said second cylindrical wall adapted for contacting said second "O" ring, whereby a transversely vibrating wave traversing said cue is attenuated by dissipation in said first and said second "O" rings.

2. The billiard cue of claim 1 further comprising:

a) a spring loaded plug comprising a base of said first female cavity, said plug having a threaded portion axially extending into said first female cavity, and b) a tapped tubular cylinder further comprising a proximate end of said insertable shaft, said threaded portion of said plug adapted for screwing into said tubular cylinder for mating said male section to said female section.

3. The billiard cue of claim 1 wherein said first "O" ring is mounted on said insertable shaft.

4. The billiard cue of claim 2 further comprising:

a) said male member comprising a two stepped cylindrical plug having first and second plug segments of first and second circumferences, said two stepped plug coaxial with said male member, said second circumference greater than said first circumference, said two stepped plug located at a distal end of said insertable shaft of said male member, said plug having said first circumference plug segment proximate said insertion shaft, and b) said first circumference having said second "O" ring mounted thereon.

5. The billiard cue of claim 4 further comprising;

a) said second cavity having a base perpendicular to the axis of said coaxial oriented cavities, said base formed at a junction of said first and said second cavities, a mechanically dissipative disk mounted proximate to, and coaxial with, said base, c) said male member joinable to said female member wherein said second plug segment abuts against said mechanically dissipative disk , and further wherein an axially oriented space occurs between said female section and said male section, wherein said male section axially "floats" relative to said cue and is movable in an axial direction by compression of said disk and said spring, whereby a longitudinally vibrating wave traversing said cue is attenuated by said dissipative disk.

6. The billiard cue of claim 5 further comprising:

a) a low friction plastic shim juxtaposed against said mechanically dissipative disk for facial contact with said first plug segment.

7. The billiard cue of claim 1 wherein said first "O" ring and said second "O" ring are rubber "O" rings.

8. The billiard cue of claim 1 wherein said first "O" ring and said second "O" ring are mechanically dissipative plastic "O" rings.

9. The billiard cue of claim 5 wherein said mechanically dissipative disk is a rubber disk.

10. The billiard cue of claim 5 wherein said mechanically dissipative disk is a plastic disk.

11. The billiard cue of claim 6 wherein said shim is a plastic shim.

12. A connector, for connecting first and second sections of a billiard cue, said connector comprising:

a) two sections adapted for joining said first and second sections of said billiard cue, the outer surfaces of said connector tapered to conform to said billiard cue taper, b) said connector further comprising an axially extending male member and an axially extending female member, c) a first end of said male member adapted for mounting in said first section of said cue, and a first end of said female member adapted for mounting in said second section of said cue, d) a second end of said male member comprising an insertable shaft, e) a second end of said female member comprising first and second coaxially oriented cavities for capturing said insertable shaft of said male member, said first cavity being a smaller diameter than said second cavity, said insertable shaft of said male member for extension through said second cavity into said first cavity, said second cavity located in said female section distal to said first end of said female member, f) said male member having first and second "O" rings circumferentially mounted thereon, said "O" rings comprising mechanically dissipative material, g) said first and said second cavities of said female member having first and second coaxial cylindrical walls, said first cylindrical wall adapted for contacting said first "O" ring, and said second cylindrical wall adapted for contacting said second "O" ring, whereby a transversely vibrating wave traversing said cue is attenuated by dissipation in said first and said second "O" rings.

13. The connector of claim 12 further comprising:

a) a spring loaded plug comprising a base of said first female cavity, said plug having a threaded portion axially extending into said first female cavity, and b) a tapped tubular cylinder further comprising a proximate end of said insertable shaft, said threaded portion of said plug adapted for screwing into said tubular cylinder for mating said male section to said female section.

14. The connector of claim 12 wherein said first "O" ring is mounted on said insertable shaft.

15. The connector of claim 12 further comprising:

a) said male member comprising a two stepped cylindrical plug having first and second plug segments of first and second circumferences, said two stepped plug coaxial with said male member, said second circumference greater than said first circumference, said two stepped plug located at a distal end of said insertable shaft of said male member, said plug having said first circumference plug segment proximate said insertion shaft, and b) said first circumference having said second "O" ring mounted thereon.

16. The connector of claim 12 further comprising;

a) said second cavity having a base perpendicular to the axis of said coaxial oriented cavities, said base formed at a junction of said first and said second cavities, b) a mechanically dissipative disk mounted proximate to, and coaxial with, said base, c) said male member joinable to said female member wherein said second plug segment abuts against said mechanically dissipative disk , and further wherein an axially oriented space occurs between said female section and said male section, wherein said male section axially "floats" relative to said cue and is movable in an axial direction by compression of said disk and said spring, whereby a longitudinally vibrating wave traversing said cue is attenuated by said dissipative disk.

17. The connector of claim 16 further comprising:

a) a low friction plastic shim juxtaposed against said mechanically dissipative disk for facial contact with said first plug segment.

18. The connector of claim 12 wherein said first "O" ring and said second "O" ring are rubber "O" rings.

19. The connector of claim 12 wherein said first "O" ring and said second "O" ring are mechanically dissipative plastic "O" rings.

20. The connector of claim 16 wherein said mechanically dissipative disk is a rubber disk.

21. The connector of claim 16 wherein said mechanically dissipative disk is a plastic disk.

22. The connector of claim 17 wherein said shim is a plastic shim.

* * * * *